United States Patent [19]

Wagner

[11] Patent Number: 4,911,813

[45] Date of Patent: Mar. 27, 1990

[54] APPARATUS FOR SELECTIVELY PLATING INTERIOR SURFACES OF ELECTRICAL TERMINALS

[75] Inventor: Richard M. Wagner, Harrisburg, Pa.

[73] Assignee: AMP Incorporated, Harrisburg, Pa.

[21] Appl. No.: 276,171

[22] Filed: Nov. 23, 1988

[51] Int. Cl.[4] ..... C25D 17/28

[52] U.S. Cl. ..... 204/224 R; 204/225

[58] Field of Search ..... 204/206, 224 R, 225, 204/279

[56] References Cited

U.S. PATENT DOCUMENTS

| | | | |
|---|---|---|---|
| 4,384,926 | 5/1983 | Wagner | 204/224 R X |
| 4,427,498 | 1/1984 | Wagner | 204/224 R X |
| 4,555,321 | 11/1985 | Wicks | 204/224 R |
| 4,687,562 | 8/1987 | Smith et al. | 204/225 X |
| 4,690,747 | 9/1987 | Smith et al. | 204/206 |

*Primary Examiner*—Donald R. Valentine

*Attorney, Agent, or Firm*—Katherine A. Nelson

[57] ABSTRACT

An improved apparatus 10 for plating interior surfaces of electrical terminals is disclosed which comprises a mandrel having first and second portions 11, 119, the first portion 11 being dielectric and the second portion 119 being conductive. The first portion 11 is mounted for rotation on a stationary conductive shaft 52 as strip fed terminals are continuously fed to, wrapped against and exited from the first portion. The second portion is mounted in a stationary position on the shaft 52. The first portion 11 includes a plurality of nozzles 49 a like plurality of anode members 80, each associated with a respective nozzle, and reciprocally movable between a plating position within a terminal 172 and a retracted position outside a terminal 172. Plating solution is supplied under pressure through the nozzles and upon respective anode members 80 and a source of electrical potential supplies electrical current flow from anode members 81, through said plating solution and into the interiors 180 of said terminals 172. Apparatus 10 is characterized in that individually biasing means is mounted on respective shaft members to define anode assemblies (80), the biasing means including a spring member (88) being cooperable with push surfaces (95) on the anode assembly (80). The means for moving the anode assemblies (80) are fixedly mounted to the conductive shaft (52) at the rear of the mandrel and the forward face of the moving means (120) defines a stop surface (133) for retaining the anode assemblies (80) in the apparatus (10). The rearward face of the moving means provides a camming surface (132). Cam followers (92) on the anode assemblies are continuously biased against a cam surface (132) of the moving means (120).

8 Claims, 6 Drawing Sheets

APPARATUS FOR SELECTIVELY PLATING INTERIOR SURFACES OF ELECTRICAL TERMINALS

FIELD OF THE INVENTION

The present invention relates to selective electroplating of electrical terminals, i.e., electroplating only the electrical contact surfaces of the terminals to the exclusion of other surfaces of the terminals and, in particular, to selectively plating terminals that are attached to a carrier strip.

BACKGROUND OF THE INVENTION

In one method of manufacturing electrical terminals, the terminals are stamped and formed from metal strip and are attached to a carrier strip. The carrier strip is useful for strip feeding the terminals through successive manufacturing operations. One of the necessary manufacturing operations involves plating, i.e., electroplating the electrical contact surfaces of the strip fed terminals with a contact metal, usually noble metals or noble metal alloys. These metals are characterized by good electrical conductivity and little or no formation of oxides that reduce the conductivity. Therefore, these metals, when applied as plating will enhance conductivity of the terminals. The high cost of the metals has necessitated precision deposition of these metals on the contact surfaces of the terminals, and not on the remaining surfaces of the terminals.

Plating apparatus, also known as a plating cell, includes an electrical anode, an electrical cathode comprised of the strip fed terminals, and a plating solution, i.e., an electrolyte of metal ions. A strip feeding means feeds the strip to a strip guide. The strip guide guides the terminals through a plating zone while the terminals are being plated. The plating solution is fluidic and is placed in contact with the anode and the terminals. The apparatus operates by passing electrical current from the anode through the plating solution to the cathodic terminals. The metal ions deposit as metal plating on those terminal surfaces in contact with the plating solution.

U.S. Pat. Nos. 4,690,747, 4,384,926, 4,427,498 and 4,555,321, owned by this assignee, disclose plating apparatus in which the interior surfaces of strip fed terminals are plated by supplying plating fluid through nozzles and over associated anode extensions or assemblies that are mounted for reciprocation into and out of the interiors of terminals. In effect, each anode extension, nozzle and terminal is a plating cell, and each apparatus comprises a plurality of plating cells. In the first three patents above, the anode extensions are mounted within their associated nozzles. In the fourth patent above, the anode extensions are mounted separately and apart from the nozzles and enter the terminals from a different direction than that of the plating fluid.

The apparatus disclosed in the four referenced patents are designed to be used with stamped and formed terminals, wherein the contact zone is located on the inside surface of a formed terminal. Each apparatus is comprised of an assembly of conductive and dielectric parts, with most of the parts mounted for rotation on a stationary axis. Each apparatus consists generally of a mandrel that is continuously rotated as strip fed electrical terminals are continuously fed to the mandrel, partially wrapped against it and exited from it. The mandrel is turreted with a plurality of nozzles distributed about its axis of rotation. Anodes are associated with the nozzles and are mounted for movement into and out of the interiors of the terminals that are against the mandrel. A conduit supplies plating solution under pressure through the nozzles and upon the anodes. The nozzles inject plating solution into the interiors of the terminals in which the anodes are received. A source of electrical potential supplies an electrical current flow from the anodes, through the plating solution and into the interiors of the terminals in which the anodes are received. In essence, each mandrel has a plurality of plating cells distributed about its axis of rotation.

Anode members or anode extensions are mounted within the assembly such that they can be moved into and out of the contact zone inside a formed terminal. The conductive anode members are either continually in mechanical engagement and electrical contact with or brought into electrical contact with an electrically charged member just prior to moving the anode member inside the terminal to selectively plate the contact zone.

In the '926, '498 and '321 patents, the anode members are held against the charged member under tension by using either a spring in the anode extension member itself or by spring loading the anode extension members against a conductive plate of the apparatus or both. The anode members are then moved into and out of aligned terminal members by hydraulic, mechanical or a combination of means.

In the '747 patent, the apparatus is provided with both a means for assuring an essentially uniform current to each of the cells and a camming means to positively move the anode means into and retract the anode means from engagement with the terminal.

When plating electrical terminals in apparatus such as those described above, it is important that the electrical terminals be properly aligned with the anode means before the anode means is moved into the terminal particularly to avoid damaging the anode means or plating apparatus. It is desirable, therefore, to have a means whereby an anode means can remain in its retracted position when there is misalignment of the terminal or a damaged terminal is present on the mandrel. Furthermore it is desirable that the non-insertion of one anode means does not damage either the anode means, the apparatus or interrupt the plating operation.

SUMMARY OF THE INVENTION

Accordingly, it is an object of the present invention to provide a means whereby the anode assembly is "self inserting."

It is another object of the invention to provide a means whereby an anode assembly may remain in a retracted position without damage, when the path of travel to the assembly's inserted position is obstructed.

It is further an object of the invention that the plating operation continue without interruption even though an anode assembly is prevented from being inserted into a corresponding terminal.

It is also an object of the invention to provide an improved insertion means for inserting the anode means into a terminal member.

The present invention described below is directed to an improved selective plating apparatus which is "self inserting" and has means for allowing an anode assembly to remain in a retracted position if its insertion path is obstructed.

In the preferred embodiment the invention is designed to be used with anode assemblies of the type disclosed in copending U.S. Ser. No. 07/275,812 entitled "Anode Assembly for Selectively Plating Interior Surfaces of Electrical Terminals" filed concomitantly herewith and incorporated by reference herein. It is to be understood that other types of anode assemblies may also be used.

The general apparatus is comprised of a mandrel having first and second portions, the first section being dielectric and mounted for rotation on a stationary conductive shaft as strip fed terminals are continuously fed to the first portion, wrapped against the first portion and exited therefrom and the second portion being conductive and mounted in a stationary position on the shaft. The first portion includes a plurality of nozzles distributed throughout its axis of rotation and a like plurality of anode members each associated with a respective one of the nozzles, each anode member being reciprocally movable between a plating position within a terminal and a retracted position outside a terminal. The apparatus also includes means for moving the anode members with respect to the terminals. The apparatus further includes a conduit supplying plating solution under pressure through the nozzles and upon the anode members and a source of electrical potential for supplying electrical current from the anode members through the plating solution and into the interior of the terminals. The apparatus has essentially a plurality of plating cells within the first mandrel portion.

The improved apparatus is characterized in that the apparatus includes means for individually biasing respective ones of the anode members in a direction toward a respective terminal in position to be plated, the biasing means being cooperable with push surfaces on the anode member. The apparatus further includes means for moving each of the anode members in a direction away from a respective terminal and against a biasing means to a retracted position, thereby storing energy in the biasing means, and means for retaining each anode member in its retracted position until a terminal to be plated is moved into a position forwardly of the anode member. The retention means is adapted to release the anode member when the terminal to be plated is moved into position forwardly of the anode member. Upon its release the biasing means acts on the push surfaces of the anode assembly and urges the anode member forwardly against a stop means of the apparatus to define a plating position of the anode member within said terminal. In the preferred apparatus, the biasing means is a spring member and the means for positively retracting the anode assembly from engagement with the terminal is a camming means. The camming means is a track formed on the outer or peripheral edge of a camming plate on the stationary portion of the apparatus.

In the assembled apparatus, a cam tracking roller member on the anode assembly cooperates with the cam track of the cam plate and with a spring member disposed on the anode assembly to store energy in the spring member while the anode assembly is in a retracted position and to release the energy in the spring member when the anode assembly is in the plating zone.

As the rotating mandrel portion of the apparatus is moved out of the plating zone, the anode members of the respective anode assemblies are removed from the terminals by a forward force exerted against the cam roller. Concomitantly therewith a compression force is exerted on the biasing or spring member disposed on shaft of the anode assembly. As the rotating mandrel moves into the plating area, the cam track abruptly changes from a first forward position to a second rearward position whereby the cam tracking roller abruptly moves forward, releasing the compression force on the spring member which drives the anode means into engagement with the terminal.

Should the path of the anode means be obstructed, the spring member of the anode assembly remains in its compressed state and the cam tracking roller remains in the upward position. In the preferred embodiment, the apparatus also includes means for providing an essentially uniform current to each of the plating cells.

The invention itself, together with further objects and its attendant advantages, will be best understood by reference to the following detailed description, taken in conjunction with the accompanying drawings.

DETAILED DESCRIPTION OF THE DRAWINGS

Figure 1:
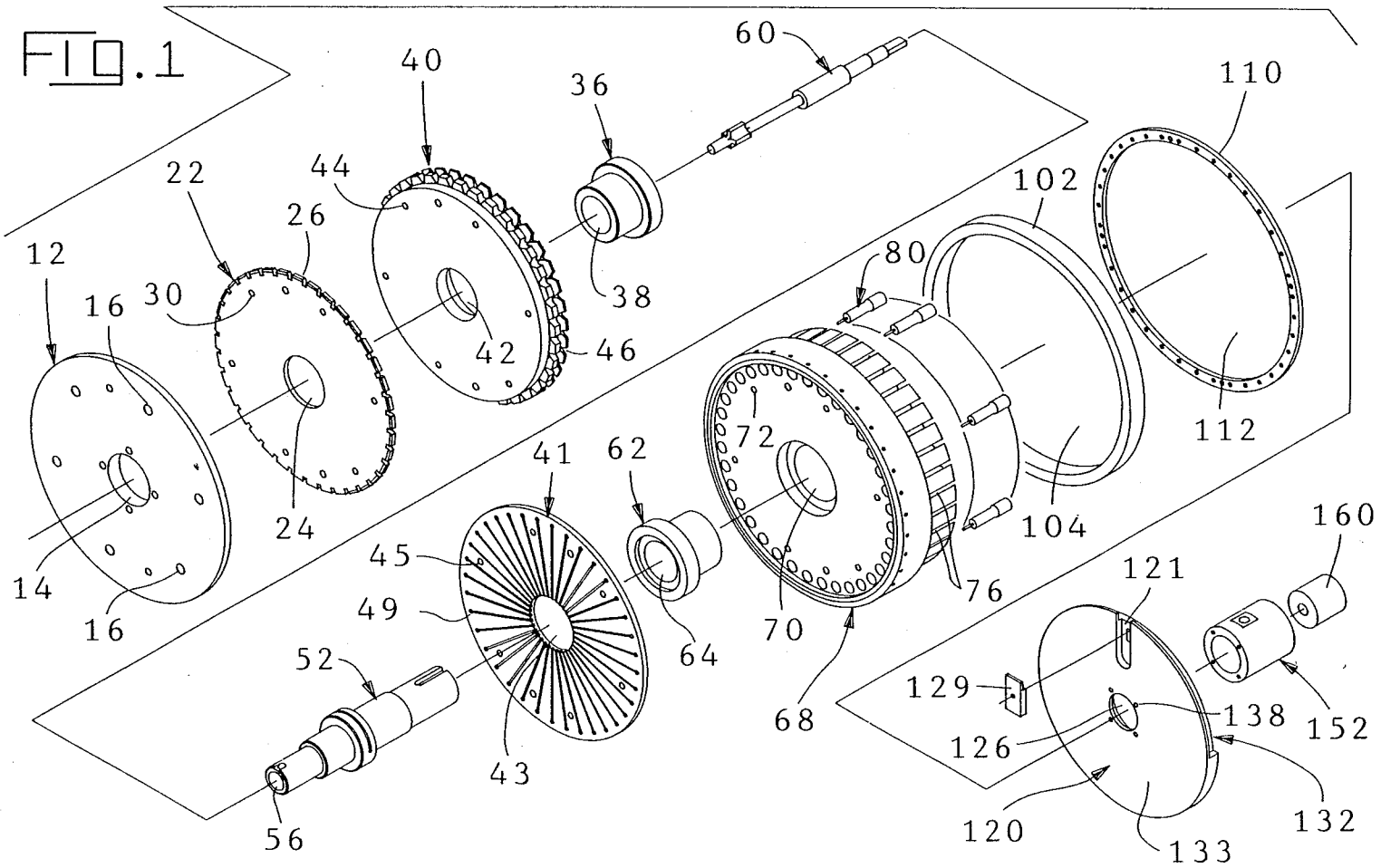
FIG. 1 is an exploded view of the apparatus for continuously plating the interior surfaces of electrical terminals according to the invention.
Figure 3:
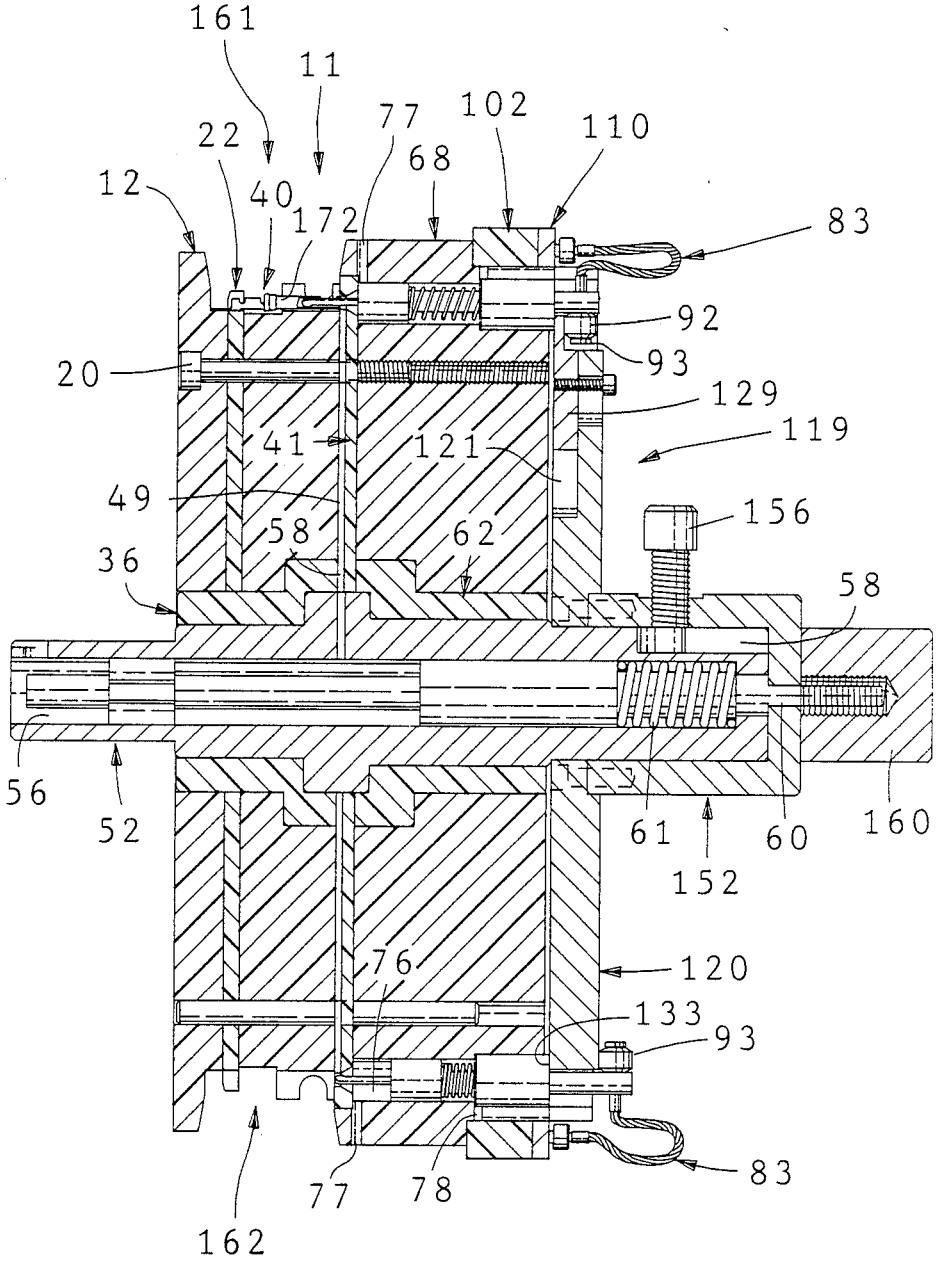
FIG. 3 is a cross-sectional view of the apparatus taken along line 3—3 of FIG. 2.

FIGS. 1 and 3 illustrate details of plating apparatus 10 in accordance with the invention.

Figure 5:
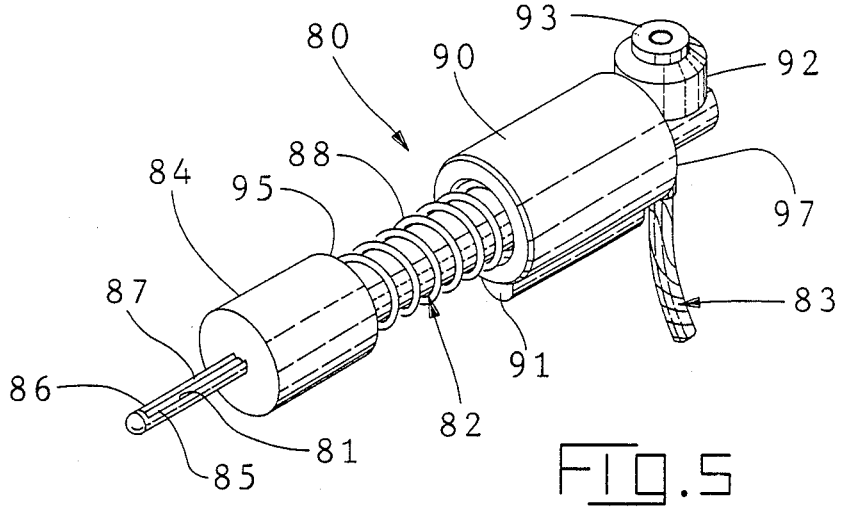
FIG. 5 is a perspective view of the anode assembly used in the apparatus of FIG. 1.

Apparatus 10 is comprised of two portions, a dielectric portion 11 and a conductive portion 119. The dielectric portion 11 is mounted for rotation on stationary conductive shaft 52 and comprises flange 12, stock drive index plate 22, socket index plate 40, nozzle plate 41, cylinder manifold 68, and socket index and cylinder manifold bearings 36 and 62 respectively. Conductive portion 119 is mounted in stationary position on stationary conductive shaft 52 and is comprised on cam member 120 and collar member 152 and cap 160. In the preferred embodiment dielectric wire collar mounting member 102 and conductive wire collar member 110 are mounted circumferentially around cylinder manifold 68 and rotate with dielectric portion 11. Mounting member 102 and wire collar member 110 provide a means for assuring electrical engagement for each of the anode assemblies 80 in apparatus 10, as will be explained below in qreater detail. For purposes of clarity, details of anode assemblies 80 have been omitted in FIG. 1. A more detailed drawing of assembly 80 is shown in FIG. 5.

Shaft 52 is profiled to cooperate with the internal apertures of bearings 36, 62 and nozzle plate 41 such that the dielectric parts are interlocked around shaft 52 and are held in place by a plurality of bolts 20 (as seen in FIG. 3). The conductive parts are held on the forward shaft 52 by a cap 160 as best seen in FIG. 3.

Figure 2:
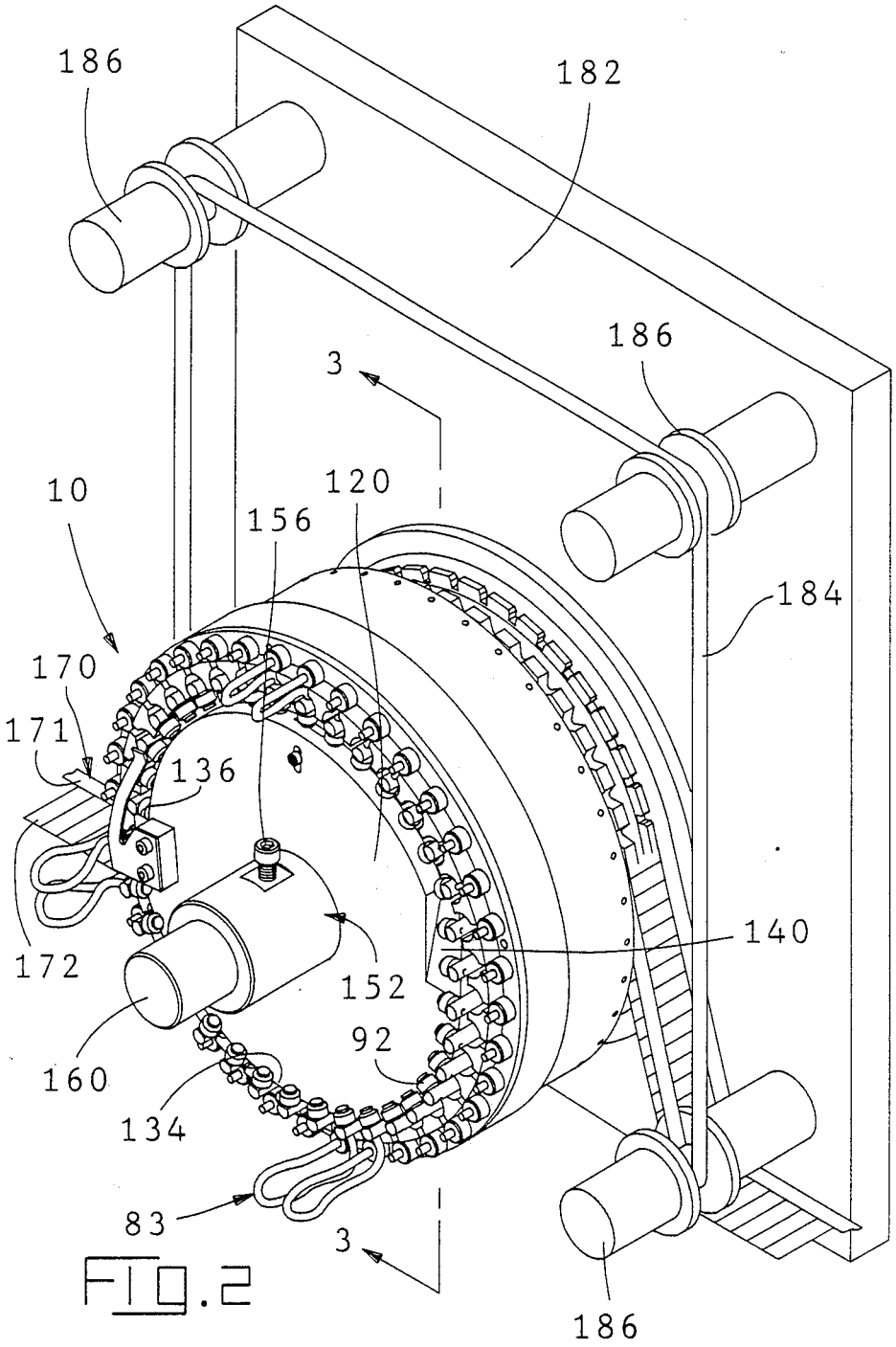
FIG. 2 is a perspective view of the assembled apparatus shown in FIG. 1 combined with a belt mechanism for feeding the strip of terminals.

As is shown in FIG. 2, assembled apparatus 10 is attached to mounting surface 182 such as a plating tank by attaching shaft 52 with mounting means (not shown) such that shaft 52 remains stationary during the plating process. As further shown in FIG. 2, terminal strip 170 is comprised of a plurality of terminals 172 integral with and serially spaced along carrier strip 171. Strip 170 is fed to the apparatus 10, partially wrapped against the apparatus 10 and fed from the apparatus 10. Strip 170 is held on the apparatus 10 by means of tension belt 184 which passes through a series of pulleys 186. Tension belt 184 holds the wrapped portion of strip 170 against the surface of the apparatus during the plating process.

Figure 6:
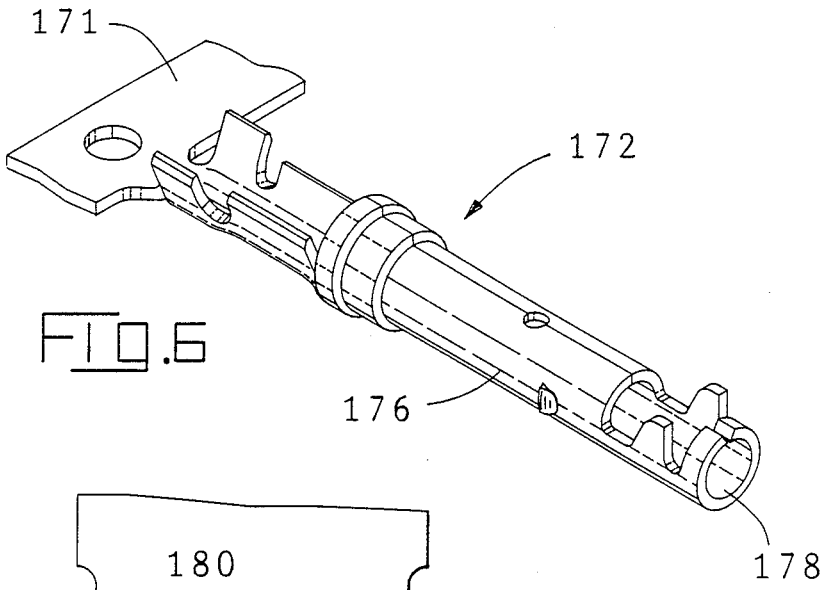
FIG. 6 is an enlarged view of a terminal that may be plated in accordance with the invention.
Figure 6A:
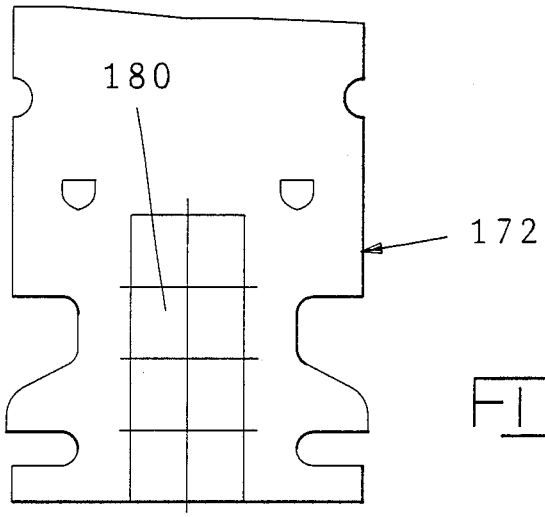
FIG. 6A is a plan view of the terminal of FIG. 6 having the terminal body opened to expose the plated contact area.

For purposes of illustrating the invention, terminal strip 170 is comprised of a plurality of socket terminals 172 as shown in FIG. 6. Terminals 172, which are attached to carrier strip 171, are comprised of a socket portion 176 having a passageway 178 therein with a contact zone 180. The selectively plated layer is generally a noble metal or a noble metal alloy or a plurality of layers of such metals. A deposit of metal plated in accordance with the invention, has observable characteristics that distinguish it from characteristics of plating by other means known in the art. When this apparatus is used in conjunction with the anode assemblies of U.S. patent application Ser. No. 07/275,812, a layer of plating is deposited only on selected areas of the internal surfaces of the terminals as best seen in FIG. 6A. It is to be understood that the insertion means of the present invention may also be used with anode assemblies of the prior art.

In the preferred embodiment dielectric parts 12, 22, 40, 41, 68 and 102 are advantageously machined from polyvinyldichloride (PVDC) polyphenylene sulfide, or the like. Bearings 36 an 62 are preferably made from high molecular weight polymers such as 1900® UHMW from Hercules, Incorporated, and other bearing materials as known in the art. Generally the dielectric materials should be thermally stable in the operation range of 130° to 140° F., be machineable, and be resistant to both alkaline an acid solutions generally in the pH range from 3 to 12.

It is to be understood that ideally, dielectric parts 2, 22, 40, 41, and 68 could be formed as individual units with their respective portions of bearings 36 and 62. At present, however, most materials suitable for bearings are not sufficiently thermally stable to be useable as the dielectric parts and conversely materials that are sufficiently thermally stable and machineable do not perform well when used as bearings.

For durability, the conductive parts 52, 60, 110, 120, 152 and 160 are preferably made of stainless sthel. The dielectric and conductive parts are assembled with bolts 20, as shown in FIG. 3 and other bolts (not shown) and as described more fully below.

Insulative flange 12 has aperture 14 therein for mounting flange onto stock index bearing 36, and a plurality of apertures 16 therein for receiving bolts 20 when the apparatus 10 is assembled. Flange 12 further has apertures therein for engagement with driving means (not shown). Insulative stock drive index plate 22 has aperture 24 therein for mounting to stock index bearing 36 and a plurality of "V" shaped notches 26 in the circumferential surface of plate 22. Stock drive index plate 22 further has apertures 30 for receiving bolts 20 when apparatus 10 is assembled. Insulated socket index plate 40 has aperture 42 therein for mounting to stock index bearing 36, and a plurality of apertures 44 for receiving bolts 20 when assembling the apparatus. Socket index plate 40 further has a plurality of socket notches 46 on the circumferential surface as best seen in FIGS. 1 and 3. Stock index bearing 36 has aperture 38 therein for mounting to shaft 52, stock bearing 36 being profiled to engage flange !2, stock drive index plate 22, and socket index plate 40. Insulated nozzle plate 41 has aperture 43 therein for mounting to shaft 52, and a plurality of apertures 45 for receiving bolts 20 when assembling the apparatus. Nozzle plate 41 further includes a plurality of electrolyte passageways 49 on a face thereof as best seen in FIGS. 1 and 3.

Cylinder manifold 68 has aperture 70 therein for mounting to a cylinder manifold bearing 62. Cylinder manifold 68 further has a plurality of apertures 72 for receiving bolts 20 when the apparatus is assembled, a plurality of profiled anode assembly receiving chambers 76, each chamber including slot 78 near its inner end as best seen in FIG. 3. Insulated cylinder manifold bearing 62 has aperture 64 therein for mounting bearing 62 and cylinder manifold 68 to shaft 52, the engaging surfaces being profiled to cooperate with each other and profiled shaft 52. In its preferred embodiment rotating portion 11 further includes dielectric wire collar mounting member 102 and conductive wire collar member 110 which cooperate with conductive stationary mandrel portion 119 to provide positive electrical connection for each anode assembly 80. Mounting member 102 and collar member 110 have apertures 104, 112 respectively therein for mounting to manifold 68. Flange 12, stock drive index plate 22, socket index plate 40, nozzle plate 41, cylinder manifold 68 an shaft 52, wire collar mounting means 102 and wire collar 110 are similar to corresponding parts in the prior art patents. Detailed descriptions will not be included herein.

Figure 3A:
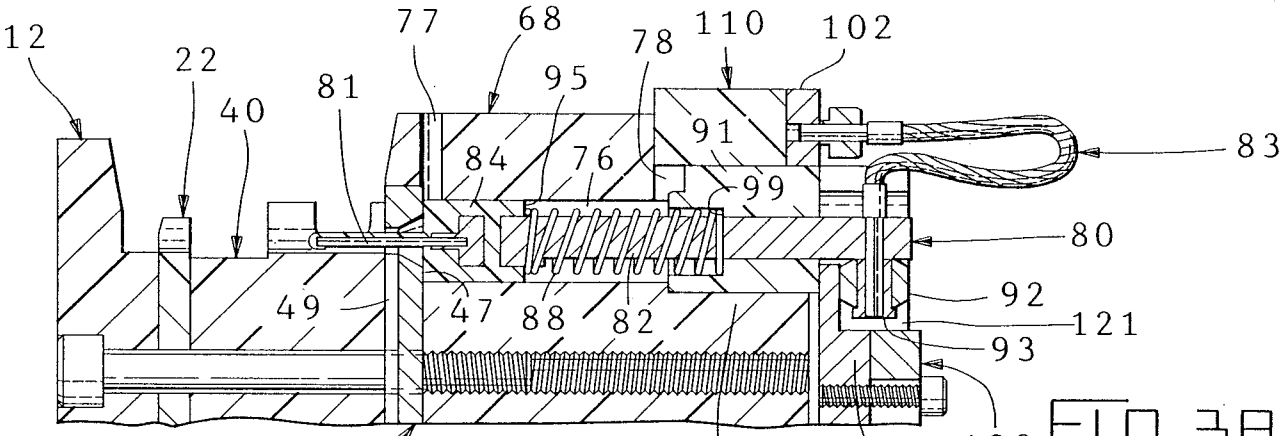
FIGS. 3A and 3B are enlarged fragmentary views of portions of the apparatus of FIG. 3 illustrating the anode assembly in its inserted and retracted positions respectively.
Figure 3B:
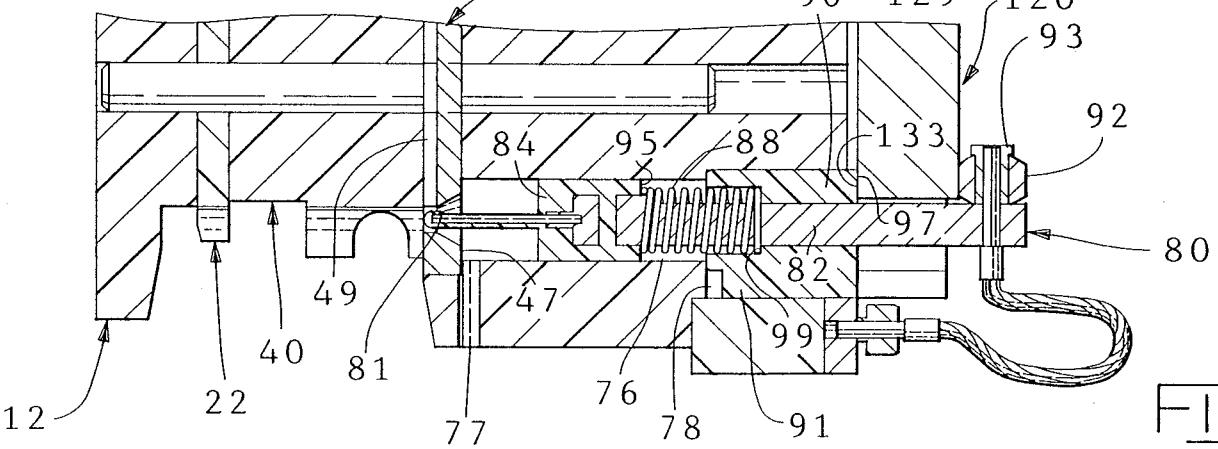

Referring now to FIGS. 3, 3A, 3B and 5, anode assemblies 80 are comprised of conductive body or shaft number 82, forward dielectric body member 84, having a forward projecting sheath means 86, spring member 88, slidably mounted rearward dielectric collar member 90 and conductive cam tracking roller 92. The ends of spring member 88 lie against rearwardly facing push surface 95 of dielectric member 84 and forwardly facing push surface 99 of collar member 90 as best seen in FIGS. 3A and 3B. Conductive body or shaft member 82 has anode member 81 disposed in sheath means 86. A portion of anode member 81 is exposed in slot 87 of sheath means 86. As shown in FIG. 3 at 161, nozzles of dielectric passageways 49 release plating solution at the rearward end of anode sheath means 86, the solution being directed thereby along the exposed portion 85 of anode means 81 in sheath means 86 and into terminal 172. FIG. 3A further shows hydraulic pressure release aperture 77 in each anode chamber 76 manifold 68, which prevents hydraulic pressure from forcing the anode assembly out of the terminal.

The details of anode assembly 80 are given in copending U.S. patent application Ser. No. 07/275,812 entitled "Anode Assembly for Selectively Plating Interior Surfaces of Electrical Terminals" and previously incorporated by reference herein.

As shown in FIGS. 1 and 3, stock drive plate 22 further has V notches 26 therein for aligning a strip of terminals 172 along a portion of the circumference of assembled apparatus 10 as described in the previous patents.

Figure 4:
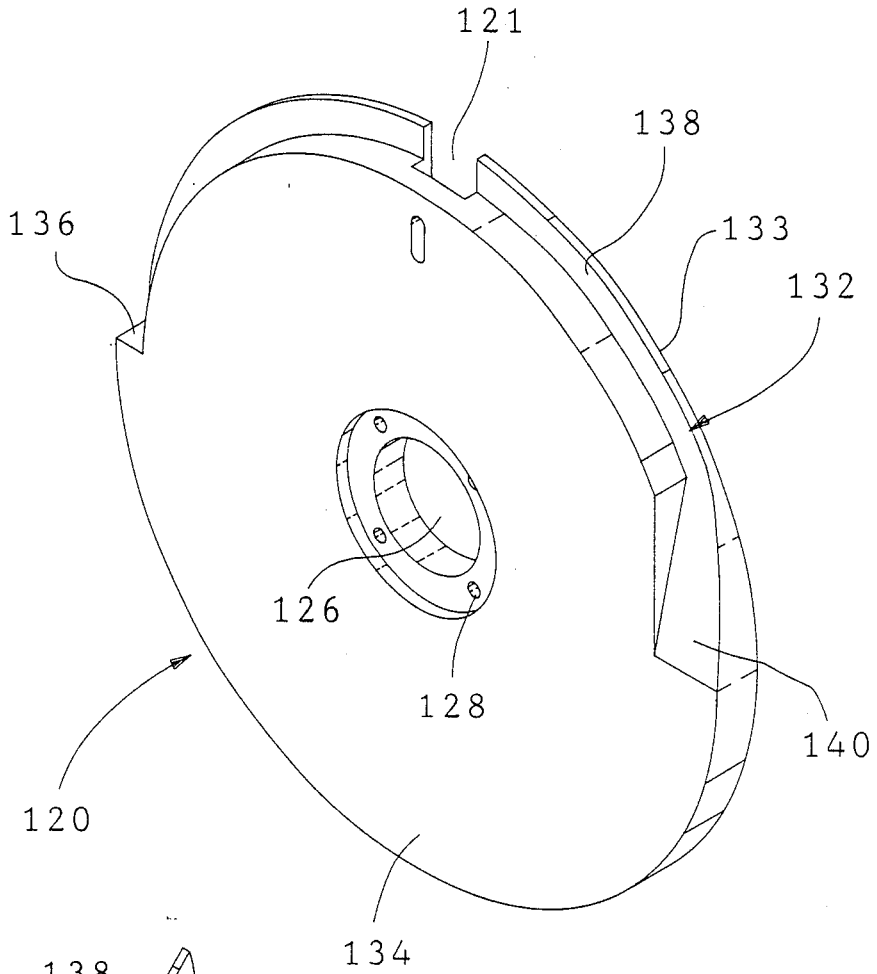
FIG. 4 is a perspective view of the camming plate of the apparatus of FIG. 1.
Figure 4A:
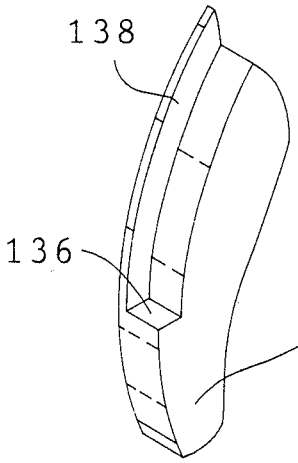
FIG. 4A is an enlarged fragmentary perspective view of one portion of the camming plate of FIG. 4.

Referring now to FIGS. 1, 3, 3A, 3B, 4 and 4A, stationary conductive portion 119 is comprised of cam plate member 120, collar member 152 and cap 160. Cam plate member 120 has aperture 126 therein for mounting to shaft 52, 138 receiving bolts in assembling apparatus 10, anode insertion aperture 121 and anode receiving gate member 129. Cam plate member 120 further includes camming surface 132 along its peripheral edge, surface 132 having a first portion 134, second portion 138, transition point 136 and transition portion 140 as best seen in FIGS. 4 and 4A. The peripheral edge portion defines a forward surface 133 which in turn defines a rearward stop means of the mandrel. Forward surface 133 acts against rearward surface 97 of dielectric collar member 90 to retain anode assemblies 80 in the mandrel. When cam tracking roller 92, shown in FIG. 5, is moved through first portion 134, anode assembly 80 is in its first or forward position with sheathed anode means 81 retracted from terminal 172 and spring member 88 is compressed, as best seen in FIG. 3B. As cam tracking roller 92 is moved along camming surface 132 and through transition point 136, roller 92 moves abruptly from first track portion 134 to second track portion 138 causing the stored energy of spring member 88 to be abruptly released, move forwardly against push surface 95 and forcing sheathed anode means 81 into a respective aligned terminal member 172, and against forward stop surface 47 in anode assembly receiving chamber 76, as best seen in FIG. 3A. As the cam tracking roller 92 moves through second track portion 138 to first portion 134, it travels along transition section 140, which gradually retracts sheathed anode means 81 from the interior of terminal 172. As shown in FIG. 4, first and second track portions 134, 138 are approximately equal to one-half the circumference of cam plate 120.

The amount of force generated by the release of spring member 88 can be adjusted by selecting a spring member having the desired characteristics. It has been found that sufficient insertion force is produced when the spring is under a tension in the range of about one pound. While it is possible to use springs having different levels of compression force, to prevent excessive wear on the cam roller 92, cam roller shaft 93 and cam plate 120, it is preferable to use a spring member that will provide sufficient force to insert the sheathed anode means without causing damage to other parts of the apparatus. Preferably the roller is made of a hardened stainless sthel suitable for a bearing surface. To ensure each anode means 81 is completely seated within its corresponding terminal 172, a leaf spring member 129, as best seen in FIG. 2, may be used to increase pressure on the end of the anode assembly 80 shortly after it has passed through transition point 136. Since there is no external plate or complimentary camming track pushing anode means 81 into position, anode assembly 80 has the capability of adjusting its lateral position within manifold 68 should anode means 81 encounter an obstruction as it tries to enter a terminal. The combination of spring member 88, slidably mounted dielectric member 92 and cam tracking roller 92 and cam plate 120 provide an apparatus wherein the anode assemblies 80 are in effect "self inserting."

In the preferred embodiment, anode assembly 80 is electrically engaged to wire collar member 110 through conductive cam wheel 92 and wire assembly 83, which provides positive electrical interconnection between the conductive portions and the assemblies 80 so that an essentially uniform current is supplied to each plating cell. Access to each of the anode assembly members 80 in their respective anode receiving chambers 76 is provided by moving gate member 121 on cam plate 120.

In the preferred embodiment, as best seen in FIG. 2, and 3, the invention further includes means for easily loading terminal strips 170 owing to cam retract rod 60 and spring 61 mounted within shaft 52. When rod 60 is activated by drive means (not shown), conductive portion containing cam assembly is moved outwardly on shaft 52 so that all of anode assemblies 80 are disengaged from the terminal area. This permits terminal strip 170 to be loaded onto the surface of the wheel without interference from anode assemblies 80. After the strip is loaded, rod 60 is again activated to engage cam plate 120 and anode assemblies 80 into their respective positions. As conductive portion 119 is moved forwardly and rearwardly, screw 156 moves along keying slot 58 to maintain alignment of dielectric and conductive portions 11 and 119 respectively. In the presently preferred embodiment, cam retract rod 60 is operated pneumatically. It is to be understood that other means may be used.

In operation driving means, not shown, rotates the apparatus 10 and strip 170 is fed onto the apparatus 10. Electrolyte solution is supplied under pressure into the conduit 56 of shaft 52. An electrical potential from source E (not shown) is applied between the cam base plate 120 and strip fed terminals 172 to produce a current I. Terminals 172 serve as cathodes onto which noble or precious or semiprecious metal ions of the electrolyte solution are to be plated. Upon rotation of apparatus 10 each of the electrolyte passageways 49 communicates with the electrolyte manifold 58 as best seen in FIG. 3. The electrolyte flows from conduit 56 through passageway 49, along the sheathed anode means 81 of anode assemblies 80 which lie within the interior passageway of terminal member 172.

The electrolyte wets the terminal interior and the anode means. Sufficient ion density and current density are present for the ions to deposit as plating upon the selected angular region or surface within the interior of the terminal in the area of the exposed surface of the anode means. The proximity of the exposed anode means portions to the contact surface to ensure that only the selected areas of the surfaces of the terminal interiors are plated rather than other interior terminal surfaces as best seen in FIG. 6A. Excess electrolyte will flow past anode means and will be returned to the plating bath. As the apparatus is further rotated passageways and corresponding electrolyte passageways 49 successively become disconnected from alignment with manifold 68, cam tracking roller 92 of anode assemblies 80 moves along cam track 136 to pull the sheathed anode means out of terminal 172 and plating deposition ceases.

Apparatus 10 has advantages over the assemblies of the prior art, in that it has fewer parts, easy access to replaceability of the anodes, and provides for auto-insertion of the anode assemblies.

The invention has been described by way of examples only. It is to be understood that other types of socket terminals may be plated in accordance with the invention. dimensional changes in strip of terminals such as center line spacing of the terminals, the width of strip of terminals and location of the contact surfaces within the terminal can be accommodated easily by corresponding dimensional changes in spacing and arrangement of the anode assemblies, indexing wheels and configuration of the anode sheath members.

It is thought that the plating apparatus of the present invention and many of its attendant advantages will be understood from the foregoing description. Changes may be made in the form, construction and arrangement of parts thereof without departing from the spirit and scope of the invention or sacrificing all of its material advantages.

What is claimed is:

1. An apparatus for plating interior surfaces of electrical terminals that are spaced apart and attached to a carrier strip, that is utilized to strip feed the terminals, comprising a mandrel rotatable about a central shaft and having a plurality of anode members retained therein and having locations distributed peripherally around the axis of rotation, with each anode member associated with a nozzle for receiving plating solution from a reservoir and adapted for transmitting said plating solution to an associated terminal to be plated, and each anode member connectable to an electrical current source, enabling electroplating of said terminal;

each said anode member is affixed to a front end of a respective shaft member reciprocally movable within said apparatus to move said anode member between a plating position within a terminal and a retracted position outside a terminal;

said apparatus includes means for individually biasing respective ones of said shaft members in a direction toward a respective said terminal in position in a terminal site forwardly of said mandrel to be plated, each said biasing means being cooperable with forward push means on said shaft member; and said apparatus further includes means for moving said ones of said shaft members each in a direction away from a respective said terminal site and against a said biasing means to a said retracted position, thereby storing energy in said biasing means, said moving means operable against respective cooperable rearward push means of said shaft members, said apparatus retaining said shaft members in said retracted position and being adapted to release said shaft member when a terminal to be plated is moved into position forwardly of said anode member, whereupon said biasing means acting on said push surfaces urges said anode member forwardly against a stop means of the apparatus defining a plating position of said anode member within said terminal;

the apparatus being characterized in that:

each said biasing means is mounted to a respective said shaft member, defining an anode assembly;

said moving means is fixedly mounted to said central shaft and along a rearward face of said mandrel and includes a peripheral edge portion extending outwardly to said anode assembly locations, said peripheral edge portion defining a forward surface to define said rearward stop means of said mandrel, said forward surface acting against a rearward surface of said biasing means to retain said anode assemblies within said mandrel and to enable storing of energy in said biasing mans when said anode assemblies are moved to said retracted position; and said peripheral edge portion of said moving means further defining a rearwardly facing camming surface cooperable with cam followers on and proximate rearward ends of said anode assemblies as said anode assemblies are rotated during rotation of said mandrel, said anode assemblies mounted within said apparatus such that said cam followers thereof are continuously biased against said cam surface by said respective biasing means.

2. The apparatus of claim 1 wherein said anode shaft member is conductive.

3. The apparatus of claim 1 wherein said peripheral edge portion of said moving means further includes at least one closable aperture in said camming surface whereby said anode assemblies may be inserted into and removed from said apparatus without dismantling said apparatus, thus facilitating repair and replacement of said anode assemblies.

4. The apparatus of claim 1 wherein said cam followers are roller members secured to a rearward portion of said shaft members of said anode assemblies.

5. The apparatus of claim 1 wherein respective said cam followers cooperate with a camming path on said camming surface, said path including first and second straight portions, each comprising almost half of the path, said first position providing for full retraction of the anode members from corresponding terminals and said second portion providing for full insertion of said anode members into terminals in line to be plated, said first and second portions being joined by a relatively short transition portion as the anode member is gently moved out of a terminal and a sharply defined insertion portion where said biasing means is quickly released to provide sufficient force against said push surfaces to insert said anode member into an electrical terminal.

6. The apparatus of claim 1 wherein said biasing means includes a coiled spring member disposed on said shaft member of said anode assembly rearwardly of said anode member.

7. The apparatus of claim 6 wherein said rearward stop surface of said biasing means is a dielectric sleeve mounted on said shaft member.

8. The apparatus of claim 1 further including means for assuring an essentially uniform electrical current to each anode assembly.

* * * * *

UNITED STATES PATENT OFFICE

CERTIFICATE OF CORRECTION

Patent No. 4,911,813 Dated March 27, 1990

Inventor(s) Richard M. Wagner

It is certified that error appears in the above-identified patent and that said Letters Patent is hereby corrected as shown below:

In the Claims:

Column 10, Claim 1, Line 12 - The word "mans" should be "means".

Title Page,
in the Abstract:

Column 2, Line 6 - The number "80" should be "81".

Signed and Sealed this

Twentieth Day of August, 1991

*Attest:*

HARRY F. MANBECK, JR.

*Attesting Officer*

*Commissioner of Patents and Trademarks*